US005395745A

United States Patent [19]

Maruyama et al.

[11] Patent Number: 5,395,745

[45] Date of Patent: Mar. 7, 1995

[54] SILVER HALIDE EMULSION, AND LIGHT-SENSITIVE MATERIAL PREPARED BY USING THE EMULSION

[75] Inventors: Yoichi Maruyama; Hiroyuki Mifune; Tetsuro Kojima, all of Ashigara, Japan

[73] Assignee: Fuji Photo Film Co., Ltd., Kanagawa, Japan

[21] Appl. No.: 24,841

[22] Filed: Feb. 25, 1993

Related U.S. Application Data

[63] Continuation-in-part of Ser. No. 904,453, Jun. 26, 1992, abandoned.

[30] Foreign Application Priority Data

Jun. 28, 1991 [JP] Japan ..... 3-183486

[51] Int. Cl.[6] ..... G03C 1/035; G03C 1/09

[52] U.S. Cl. ..... 430/567

[58] Field of Search ..... 430/567, 603, 601

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 4,806,461 | 2/1989 | Ikeda et al. | 430/567 |
| 4,923,794 | 5/1990 | Sasaki et al. | 430/603 |
| 5,068,173 | 11/1991 | Takehara et al. | 430/567 |
| 5,215,880 | 6/1993 | Kojima et al. | 430/601 |

FOREIGN PATENT DOCUMENTS

| | | |
|---|---|---|
| 800958 | 12/1968 | Canada . |
| 1295462 | 11/1972 | United Kingdom . |
| 1396696 | 6/1975 | United Kingdom . |

OTHER PUBLICATIONS

James, T. H., ed., Theory of the Photographic Process, 4th edition, p. 20, Macmillan Publishing, 1977.

*Primary Examiner*—Janet C. Baxter

*Attorney, Agent, or Firm*—Birch, Stewart, Kolasch & Birch

[57] ABSTRACT

Disclosed herein is a silver halide emulsion which contains grains made of silver chloroiodobromide, silver iodobromide, or silver chlorobromide, each of said grains having at least one dislocation line and chemically sensitized with a tellurium sensitizer which has a pseudo-first order reaction rate constant k of $1\times10^{-8}$ to $1\times10^{0}$ $min^{-1}$. Also disclosed herein is a silver halide photographic light-sensitive material which comprises at least one layer made of the silver halide emulsion, in which the grains occupying at least 50 wt % of said emulsion layer.

14 Claims, 1 Drawing Sheet

SILVER HALIDE EMULSION, AND LIGHT-SENSITIVE MATERIAL PREPARED BY USING THE EMULSION

This application is a continuation-in-part of application Ser. No. 07/904,453, filed on Jun. 26, 1992, now abandoned.

BACKGROUND OF THE INVENTION

1. Field of the Invention

The present invention relates to a silver halide emulsion and also to a light-sensitive material prepared by using the emulsion. More particularly, it relates to a silver halide emulsion which excels in photographic sensitivity and also to a light-sensitive material which is prepared by using this silver halide emulsion.

2. Description of the Related Art

Dislocation in silver halide grains are described in many theses, among which are:

1. C. R. Berry, J. Appl. Phys., 27,636 (1956)
2. C. R. Berry, D. C. Skilman, J. Appl. Phys., 35, 2165 (1964)
3. J. F.Hamilton, Phot. Sci. Eng., 11, 57 (1967)
4. T. Shiozawa, J. Soc. Phot. Sci. Jap., 34, 16(1971)
5. T. Shiozawa, J. Soc. Phot. Sci. Jap., 35, 213(1972)

These theses teach that the dislocation in crystals can be observed by means of X-ray diffraction analysis or low-temperature transmission electron microscope. Also do they disclose that various types of dislocation occur in crystals when strain is applied, on purpose, to the crystals.

Intentional introduction of dislocation into tabular silver halide grains, thereby to improve the photographic properties thereof, is known in the art.

JP-A-63-220238 discloses a method of forming dislocation lines in the sides of tabular grains.

JP-A-1-102547 discloses a method of forming dislocation lines in the major surfaces of tabular grains.

JP-A-1-314201 discloses a method of forming dislocation lines in the corners of tabular grains. ("JP-A" means Published Unexamined Japanese Patent Application.)

Method of tellurium sensitization and tellurium sensitizers are generally described in several references, such as U.S. Pat. Nos. 1,623,499, 3,320,069, 3,772,031, 3,531,289, 3,655,394, and 4,704,349, British Patents 235,211, 1,121,496, 1,295,462, 1,396,696, and 2,160,993, Canadian Patent 800,958, and JP-A-61-67845. However, specific tellurium sensitizers are described in detail in a few references only, such as British Patents 1,295,462 and 1,396,696, and Canadian Patent 800,958.

SUMMARY OF THE INVENTION

The object of this invention is to provide a silver halide emulsion which contains grains having dislocation lines and which therefore has high sensitivity, and to provide a light-sensitive material prepared by using this emulsion.

In an aspect of this invention, there is provided a silver halide emulsion which contains grains made of silver chloroiodobromide, silver iodobromide, or silver chlorobromide, each of said grains having at least one dislocation line and chemically sensitized with a specified tellurium sensitizer.

In another aspect of the invention, there is provided a silver halide photographic light-sensitive material which comprises a support, at least one layer formed on the support and made of a silver halide emulsion which contains grains made of silver chloroiodobromide, silver iodobromide, or silver chlorobromide, internally having at least one dislocation line, and chemically sensitized with a specified tellurium sensitizer, said grains occupying at least 50 wt % of the emulsion layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
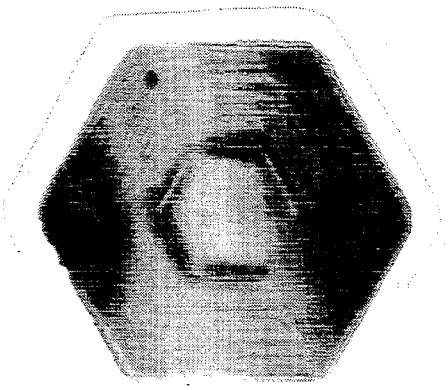
FIG. 1 is a photograph taken by a transmission electron microscope at magnification of 40,000, showing the grains contained in emulsion Em-A according to the present invention.

The silver halide emulsion according to the invention contains tabular grains which have dislocation.

Dislocation in silver halide grains can be observed by a direct method disclosed in J. F. Hamilton, Phot. Sci. Eng., 11, 57 (1967) and T. Shiozawa, J. Soc. Phot. Sci. Jap., 35,213(1972), in which use is made of a transmission electron microscope at low temperatures. More specifically, silver halide grains are extracted from the emulsion, not applying so high a pressure as to cause dislocation in the grains, are place on a mesh designed for use in electron microscope observation, and are cooled not to have damages (e.g., printouts) due to electron beams. Then, photos of the sample thus prepared are taken by the camera attached to the microscope. The thicker the grains, the more hard it is for electron beams to pass through the grains. Hence, a high-voltage electron should better be employed to obtain clear photos of the grains. (For example, 400 KV or more be applied to the microscope to obtain clear photos of grains 0.5 $\mu$m thick.) In the photos thus taken, the dislocation lines in each grain can be counted.

It is desirable that each grain has at least one dislocation line, preferably 5 dislocation lines or more, more preferably 10 dislocation lines or more. In the case where dislocation lines exist densely or cross one another, it would be difficult to count them accurately. Even in this case, an approximate number of dislocation lines can be determined in units of tens, such as 10, 20, and 30. Hence, a grain having tens of dislocation lines can be well distinguished from one having a few dislocation lines only. The average number of lines per grain is found by dividing the number of lines counted of 100 or more grains by the number of the grains inspected.

Dislocation lines can be formed in grains, at desired timing and at desired positions in each grain, by known methods, such as those disclosed in JP-A-63-220238, and JP-A-3-314201 and 2-34090. It is desirable that dislocation lines be formed in the grains when 30 to 99%, preferably 50 to 95%, of all silver used is consumed during the process of preparing the emulsion. Dislocation lines are formed in the major surfaces or apices of each grain. In the case of tabular grains, dislocation lines can be formed in the twin faces. Nonetheless, the positions of dislocation lines are not limited to these. Further, some of the dislocation lines can be formed at particular positions, while the others at other specific positions.

The tellurium sensitizers used in the tellurium sensitization of the present invention are tellurium compounds which form silver telluride in the surface or interior of a silver halide grain, which is considered to function as a sensitization nucleus.

The tellurium sensitizers used in the present invention have a pseudo-first order reaction rate constant k of $1\times10^{-8}$ to $1\times10^{0}$ $min^{-1}$ as described below.

The rate with which silver telluride is formed in the silver halide emulsion can be determined by the following test:

When a tellurium sensitizer is added in a great amount (e.g., $1\times10^{-3}$ mol/mol Ag), the silver telluride formed absorbs light beam of the visible region. Hence, the method applied for sulfur sensitizers disclosed in E. Moisar, "Journal of Photographic Science," Vol. 14, page 181 (1966) and Ibit, Vol 16, page 102 (1968) can be applied. Therefore, the relative rate at which silver telluride is formed can easily be obtained by the same method as used in determining the amount of silver sulfide formed in a silver halide emulsion from the infinite reflectivity of the emulsion to light beams of the visible region (520 nm) in accordance with the Kubelka-Munk formula. Since this reaction is apparently similar to a first order reaction, a pseudo-first order reaction rate constant k can be obtained, too.

Next, it will be described how to obtain the pseudo-first order reaction rate constant k.

An emulsion which contains octahedral silver bromide grains having an average size of 0.5 μm (containing 0.75 mol of AgBr and 80 g of gelatin, per kilogram) is maintained at 50° C., while holding pH and pAG at 6.3 and 8.3, respectively. A tellurium compound dissolved in an organic solvent (e.g., methanol) is added to the emulsion, in an amount of $1\times10^{-3}$ mol/mol Ag. The resultant emulsion is filled in a cell having a thickness of 1 cm. Then, the reflectivity (R) change of the emulsion to light beams of 520 nm with the time is detected by means of a spectrophotometer having an integrating sphere, using the reflectivity of a blank emulsion as reference. Reflectivity, thus detected, is substituted in the Kubelka-Munk formula, $(1-R)^2/2R$. The time when the value of $(1-R)^2/2R$ becomes 0.01 is measured. The pseudo-first order reaction rate constant k ($min^{-1}$) is determined from the time thus measured. If no silver telluride is formed at all, R=1, and the Kubelka-Munk value is 0 as in the case where no telluride is present. Preferable is a tellurium compound which is found to have an apparent pseudo-first order reaction constant k of $1\times10^{-8}$ to $1\times10^{0}$ $min^{-1}$ when tested in exactly the same way as described above.

The pseudo-first order reaction rate constant k of the tellurium sensitizers of the present invention, which have been obtained by performing the test described above, are as follows, for example:

| | |
|---|---|
| Compound 7 | ca. $4\times10^{-3}$ $min^{-1}$ |
| Compound 10 | ca. $2\times10^{-3}$ $min^{-1}$ |
| Compound 12 | ca. $8\times10^{-4}$ $min^{-1}$ |
| Compound 18 | ca. $2\times10^{-4}$ $min^{-1}$ |
| Compound 4 | ca. $7\times10^{-5}$ $min^{-1}$ |

Note that these compounds are exemplified tellurium sensitizers, which will be presented later.

In the case where a tellurium sensitizer is added in so small an amount that the absorption of light beam of the visible region can hardly be detected, the silver telluride formed is separated from the unreacted tellurium sensitizer, to determine the quantity of the silver telluride. For instance, the silver telluride formed can be separated by immersion in an aqueous solution of a halogen salt or a water-soluble mercapto compound, and then a small amount of Te can be quantitatively analyzed by means of atomic absorption spectrometry. The reaction rate varies by several orders, depending on not only the type of the tellurium compound, but also the silver halide composition of the emulsion tested, the test temperature, the values of pAg and pH, and the like. The tellurium sensitizers preferred for use in the present invention are tellurium compounds which can form silver telluride when reacted with a silver halide emulsion which has the same halide composition and crystal habit as those of the emulsion to be used. The tellurium sensitizer preferably used in the present invention can react with a silver halide emulsion at 40° to 95° C., at pH value of 3 to 10, or at a pAg value of 6 to 11. More preferable tellurium sensitizers have a pseudo-first order reaction rate constant k of $1\times10^{-7}$ to $1\times10^{1}$ $min^{-1}$ when tested by the method specified above at 40° to 95° C., at pH value of 3 to 10, or at a pAG value of 6 to 11.

Of the tellurium compounds specified above, those represented by the following formula (I) or (II) are suitable for use in this invention:

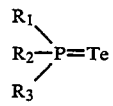

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom.

The formula (I) will now be explained in detail.

The aliphatic groups represented by $R_1$ to $R_{10}$ in the formula (I) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_1$ to $R_7$ in the formula (I) are preferably those having 6 to 30 carbon atoms. Particularly preferred is aryl group having 6 to 20 carbon atoms and present in the form of a single ring or a condensed ring, such as phenyl or naphthyl.

The heterocyclic groups identified by $R_1$ to $R_7$ in the formula (I) are saturated or unsaturated 3- to 10-membered heterocyclic groups, each having at least one atom selected from the group consisting of a nitrogen atom, an oxygen atom and a sulfur atom. They can be each a single ring, or can combine with an aromatic group or another heterocyclic group, thus forming a condensed ring. Preferable are 5- or 6-membered aromatic heterocyclic group such as pyridyl, furyl, thienyl, thiazolyl, imidazolyl, and benzimidazolyl.

The cations represented by $R_4$ and $R_7$ in the formula (I) are of alkali metal or ammonium.

The halogen atom identified by X in the formula (I) is, for example, a fluorine atom, a chlorine atom, a bromine atom, or a iodine atom.

The aliphatic groups, the aromatic groups, and the heterocyclic groups—all specified above—can be substituted. Typical examples of the substituent groups are: alkyl group, aralkyl group, alkenyl group, alkynyl group, aryl group, alkoxy group, aryloxy group, amino group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoric acid amide group, diacylamino group, imido group, alkylthio group, arylthio group, a halogen atom, cyano group, sulfo group, carboxyl group, hydroxyl group, phosphono group, nitro group, and heterocyclic group. These groups can be substituted.

In the case where two or more substituent groups are used, they are either identical or different.

$R_1$, $R_2$, and $R_3$ can combine together and with phosphorus atoms, forming a ring. Alternatively, $R_5$ can combine with $R_6$, thus forming a nitrogen-containing heterocyclic ring.

In the formula (I), $R_1$, $R_2$, and $R_3$ are preferably aliphatic groups or aromatic groups. More preferably, they are alkyl groups or aromatic groups.

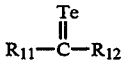

Formula (II)

where $R_{11}$ is aliphatic group, aromatic group, heterocyclic group or $—NR_{13}(R_{14})$, $R_{12}$ is $—NR_{15}(R_{16})$, $—N(R_{17})N(R_{18})R_{19}$ or $—OR_{20}$, $R_{13}$ to $R_{20}$ are hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ can combine, forming a ring.

The general formula (II) will now be explained in detail.

The aliphatic groups represented by $R_{11}$ and $R_{13}$ to $R_{20}$ in the formula (II) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_{11}$ and $R_{13}$ to $R_{20}$ in the formula (II) are preferably those having 6 to 30 carbon atoms. Particularly preferred is aryl group having 6 to 20 carbon atoms and present in the form of a single ring or a condensed ring, such as phenyl group or naphthyl group.

The heterocyclic groups identified by $R_{11}$ and $R_{13}$ to $R_{20}$ in the formula (II) are saturated or unsaturated 3- to 10-membered heterocyclic groups, each having at least one atom selected from the group consisting of a nitrogen atom, an oxygen atom and a sulfur atom. They can be each a single ring, or can combine with an aromatic group or another heterocyclic group, thus forming a condensed ring. Preferable are 5- or 6-membered aromatic heterocyclic group such as pyridyl, furyl, thienyl, thiazolyl, imidazolyl, and benzimidazolyl.

It is desirable that the acyl groups identified by $R_{13}$ to $R_{20}$ shown in the formula (II) have 1 to 30 carbon atoms. More preferably, they are acyl groups having 1 to 20 carbon atoms and present in the form of a straight chain or a branch. Examples of these acyl groups are acetyl, benzoyl, formyl, pivaloyl, and decanoyl.

In the case where $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ combine, forming a ring, each of them is, for example, alkylene group, allylene group, or alkenylene.

The aliphatic groups, the aromatic groups, and the heterocyclic groups, described above, can be substituted by the substituent groups specified in the general formula (I).

In the formula (II), $R_{11}$ is preferably aliphatic group, aromatic group, or $—NR_{13}(R_{14})$, and $R_{12}$ is $—NR_{15}(R_{16})$. $R_{13}$, $R_{14}$, $R_{15}$ and $R_{16}$ are aliphatic groups or aromatic groups.

More preferably, in the formula (II), $R_{11}$ is aromatic group or $—NR_{13}(R_{14})$, $R_{12}$ is $—NR_{15}(R_{16})$, and $R_{13}$, $R_{14}$, $R_{15}$ and $R_{16}$ are alkyl groups or aromatic groups. Preferably, $R_{11}$ and $R_{15}$, and $R_{13}$ and $R_{15}$ are attached to each other through alkylen group, arylene group, aralkylene group, or alkenylene group.

Specific examples of the compounds represented by the formulas (I) and (II) are as follows. It should be noted that the compounds used in the invention are not limited to these specified below.

1. $(nC_4H_9)_3P{=}Te$
2. $(tC_4H_9)_3P{=}Te$
3. 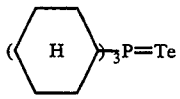
4. $((i)C_3H_7)_3P{=}Te$
5. 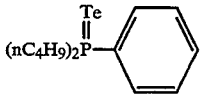
6. 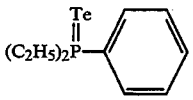
7. $((i)C_4H_9)_3P{=}Te$ -continued 8. $((i)C_4H_9)_2\overset{\overset{Te}{\|}}{P}C_4H_9(n)$ 9. $(i)C_3H_7\overset{\overset{Te}{\|}}{P}(C_4H_9(n))_2$ 10. $((i)C_3H_7)_2\overset{\overset{Te}{\|}}{P}C_4H_9(n)$ 11. $(i)C_3H_7\overset{\overset{Te}{\|}}{P}(C_4H_9(i))_2$ 12. $((i)C_3H_7)_2\overset{\overset{Te}{\|}}{P}C_4H_9(i)$ 13. $((i)C_3H_7)_2\overset{\overset{Te}{\|}}{P}C_8H_{17}(n)$ 14. $C_2H_5\overset{\overset{Te}{\|}}{P}(OC_2H_5)_2$ 15. $(nC_4H_9O)_3P{=}Te$ 16. $C_2H_5\overset{\overset{Te}{\|}}{P}(N(CH_3)_2)_2$ 17. 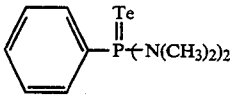

18. $((CH_3)_2N)_3P{=}Te$

19. $((CH_3)_3SiO)_2\overset{\overset{Te}{\|}}{P}H$

20. 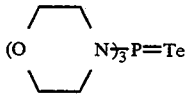

21. $(C_2H_5)_2\overset{\overset{Te}{\|}}{P}N(C_2H_5)_2$

22. $H_2\overset{\overset{Te}{\|}}{P}NH_2$

23. 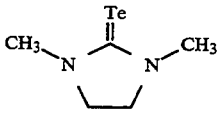

24. 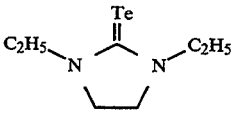

25. 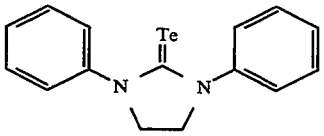

-continued

26. 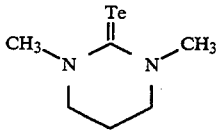

27. 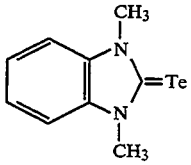

28. 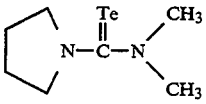

29. 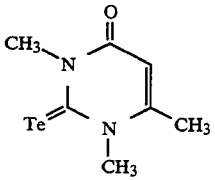

30. 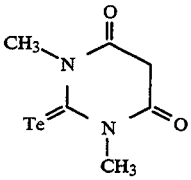

31. 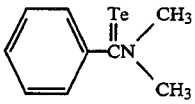

32. 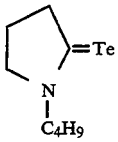

33. 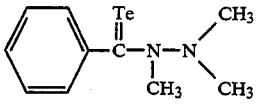

34. 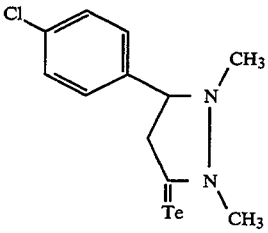

35. 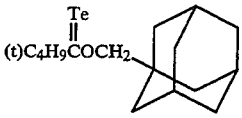

-continued

36. 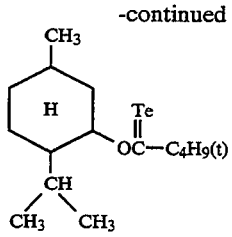

37. 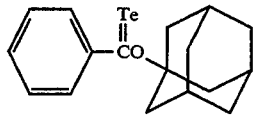

38. 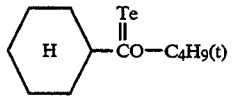

The compounds of the formulas (I) and (II), which are used in this invention, can be synthesized by the methods known in the art, as is disclosed in Journal of Chemical Society (A), 2927 (1969), Journal of Organometallic Chemistry, 4,320 (1965), ibid, 1,200 (1963), ibid, 113, C35 (1976), Phosphorus Sulfur 15, 155 (1983), Chemische Berichte, 109, 2996 (1976), Journal of Chemical Society Chemical Communication, 635 (1980), ibid, 1102 (1979), ibid, 645 (1979), ibid, 820 (1987), Journal of Chemical Society Perkin Transaction 1,2191 (1980), The Chemistry of Organo Seleniumand Tellurium Compounds, Vol. 2, pp. 216–267 (1987).

No specific examples of emulsions have been reported, which are prepared by using the compounds of the formula (I) or (II) as tellurium sensitizers. These compounds can achieve remarkable effects, though it remains difficult to ascertain the sensitization, fog and other photographic functions they perform.

In the present invention, tellurium sensitizers are used in an amount of $10^{-8}$ to $10^{-2}$ mol per mol of silver halide, preferably $10^{-7}$ to $5\times10^{-3}$ mol per mol of silver halide, depending on the type of silver halide grains used and the conditions of chemical ripening performed.

There is no limitation to the conditions in which to effect chemical sensitization in the present invention. However, it is desirable that the silver halide grains be chemically sensitized at an PAg value of 6 to 11, preferably 7 to 10 and at a temperature of 40° to 95° C., preferably 50° to 85° C.

Precious-metal sensitizers using gold, platinum, palladium, iridium or the like, should preferably be used in the present invention, along with the tellurium sensitizers. Specific example of precious-metal sensitizers are: chloroauric acid, potassium chloroaurate, potassium auric thiocyanate, gold sulfide, gold selenide, and the like. These precious-metal sensitizers can be used in an amount of about $10^{-7}$ to about $10^{-2}$ mol per mol of silver halide.

In this invention, it is also preferable to use sulfur sensitizers, too. Specific examples of sulfur sensitizers are: thio sulfates (e.g., hypo), thioureas (e.g., diphenyl thiourea, triethyl thiourea, and allyl thiourea), and known unstable sulfur compounds (e.g., rhodanines). These sulfur sensitizers can be used in an amount of about $10^{-7}$ to about $10^{-2}$ mol per silver halide.

Also it is desirable that selenium sensitizers be used, too, in the present invention. The unstable selenium sensitizer disclosed in JP-B-44-15748 is an preferable example. Specific examples of selenium sensitizers are: colloidal selenium, selenoureas (e.g., N,N-dimethyl selenourea, selenourea, tetramethyl selenourea), selenoamides (e.g., selenoaceto acid, N,N-dimethylselenobenzamide), selenoketones (e.g., selenoacetone, selenobenzophenone), selenides (e.g., triphenyl phosphineselenide, diethylselenide), selenophosphate (e.g., tri-p-tolylselenophosphate), selenocarboxylic acid, esters, and isoselenocyanates. These selenium sensitizers can be used in an amount of about $10^{-8}$ to about $10^{-3}$ mol per mol of silver halide.

Preferably, tellurium sensitization is carried out in this invention, in the presence of a solvent for dissolving the silver halide. Specific examples of this solvent are: thiocyanate (e.g., potassium thiocynate), thioether compound (e.g., the compounds disclosed U.S. Pat. Nos. 3,021,215 and 3,271,157, JP-B-58-30571 ("JP-B" means Published Examined Japanese Patent Application), and JP-A-60-136736, particularly 3,6-dithia-1,8-octanediol), and tetra-substituted thiourea compound (e.g., the compounds disclosed in JP-B-59-11892 and U.S. Pat. No. 4,221.,863, particularly tetramethyl thiourea). Other examples of the solvent are: the thion compounds disclosed in JP-B-60-11341, the mercapto compounds disclosed in JP-B-63-29727, the meso-ion compounds disclosed in JP-A-60-163042, the selenoether compounds disclosed in U.S. Pat. No. 4,782,013, the telluroether compounds disclosed in JP-A-2-118566, and sulfites. Of these examples, thiocyanate, thioether compounds, tetra-substituted thiourea compounds, and thione compounds are preferred. The solvent can be used in an amount of about $10^{-5}$ about $10^{-2}$ mol per mol of silver halide.

The emulsion of this invention contains tabular silver halide grains which have an aspect ratio of 3 or more, preferably 3 or more and less than 8. The term "tabular grain" is the general name of a grain which has one twin face or two or more parallel twin faces. A "twin face" is a (111) face, with respect to which the ions at lattice points on one side symmetrical to those ions at lattice points on the other side. The tabular grains look a triangle, a hexagon, a triangle having rounded apices, or a hexagon having rounded apices. They have two parallel surfaces each, which are triangular, hexagonal, or quasi-circular.

The term "aspect ratio" is the ratio of the diameter of any tabular grain having a lattice diameter of 0.1 μm or more, to the thickness of that tabular grain. The thickness of a tabular grain is determined easily, first by vapor-depositing metal on a grain and on a latex for reference, applying the metal vapor and the latex slantwise, then by measuring the shadow length of the metal deposit and that of the latex deposit, both on an electron-microscope photograph, and finally by calculating the thickness of the grain from the shadow lengths thus measured.

The diameter of any grain contained in the emulsion of the invention is represented in terms of equivalent-circle diameter, i.e., the diameter of a circle having the same area as the projected image of the grain. The projected area of the grain can be determined by measuring the area of the grain on an electron-microscope photograph and modifying the area, thus measured, with the magnification of the photograph.

Preferably, the tabular grains have a diameter of 0.15 to 0.5 μm and a thickness of 0.05 to 1.0 μm.

The average aspect ratio of the tabular grains can be obtained by measuring the aspect ratios of at last 100 silver halide grains, and then by dividing the sum of the aspect ratio by the number of the grains. Alternatively, it can be found as the ratio of the average diameter of the grains to the average thickness thereof.

It is desirable that the emulsion of the invention contain tabular grains which have aspect ratios of 3 or more. Preferably, the grains have an average aspect ratio of 3 or more, but less than 8. Also it is desirable that the grains having such aspect ratios occupy 50% or more, preferably 80% or more, of the total projected area of all silver halide grains contained in the emulsion.

Monodispersed tabular grains are particularly suitable for use in the emulsion of the invention. If used, they will achieve desirable effects in some cases. The structure of monodispersed tabular grains and the method of preparing them are disclosed in, for example, JP-A-63-151618. More specifically, grains having two parallel hexagonal surfaces each, whose longest side is not more than twice longer than the shortest side, occupy 70% or more of the total projected area of all silver halide grains contained in the emulsion. The grains are monodispersed such that they have a variation coefficient of 20% or less, said coefficient obtained by dividing the standard deviation of the equivalent-sphere diameter by the average diameter of the grains.

Silver halide grains of another type, which are suitable for use in this invention, are regular grains which have no twin faces. Among these regular crystals are: cubic crystals having (100) faces; octahedral crystals having (111) faces; and dodecahedral grains having (110) faces, disclosed in JP-B-55-42737 and JP-A-60-222842. Also, the grains having (hl1) faces such as (211) faces, the grains having (hh1) faces such as (331) faces, the grains having (hk0) faces such as (210) faces, the grains having (hk1) faces such as (321) faces—all described in Journal of Imaging Science, vol. 30, p. 247 (1986)—can be used for specific purposes, though some cares must taken to prepare these grains. Also, tetradecahedral grains each having both a (100) face and a (111) face, grains each having both a (100) face and a (110) face, grains each having both a (111) face and a (110) face, or any other type of grains each having two or more different faces can be used in accordance with the application.

The silver halide grains used in this invention are made of silver bromide, silver chloride, silver iodide, silver chlorobromide, silver chloroiodide, silver iodobromide, or silver chloroiodobromide. The emulsion used in the invention can contain not only these silver halide grains, but also grains of any other silver salt, such as silver rhodanide, silver sulfide, silver selenide, silver carbonate, silver phosphate or silver salt of organic acid. Alternatively, a part of each silver halide grain can be made of any other silver salt.

To prepare a silver halide photographic light-sensitive material which can be developed and desilvered (i.e., bleached, fixed and bleach-fixed) at high speeds, it is desirable that the silver halide grains have a high silver chloride content. To restrain the development, it is preferable that the silver halide grains contain silver iodide. The optimum amount in which to use silver iodide depends on the type of the light-sensitive material. Preferably, the silver iodide content is 0.1 to 15 mol % for X-ray sensitive material, and 0.1 to 5 mol % for microfilm and graphic art film. For photographic light-sensitive materials the typical example of which is color negative film, the silver iodide content ranges from 1 to 30 mol %, preferably 5 to 20 mol %, more preferably 8 to 15 mol %. In order to lessen lattice stain in each silver halide grain, it is recommendable that silver chloride be contained in the grain.

It is desirable that the silver halide emulsion for use in this invention contain grains which are not homogeneous. Typical example of such grains are those of double structure, each consisting of a core and shell which have different halogen compositions, as is disclosed in JP-B-43-13162, JP-A-61-215540, JP-A-60-222845, JP-A-60-143331, JP-A-61-75337, and some other references. Other examples of such grains are: those of triple structure, each formed of a core, a first shell and a second shell which have different halogen compositions, as is disclosed in JP-A-60-222844; and those of double structure, each coated with a thin layer of silver halide which has a halogen composition different from those of the core and shell.

Apart from the grains of the three types described in the preceding paragraph, grains having so-called "junction structure" can be used in the present invention. Various examples of grains having the junction structure are disclosed in JP-A-59-133540, JP-A-58-108526, European Patent 119,290A2, JP-B-58-24772, JP-A-59-16254, and some other references. A junction-structure grain consists of a host crystal and a junction crystal which are different in composition. The junction crystal can be formed on the edge or corner portion or surface portion of the host crystal. The host crystal is one which is homogeneous in composition or one which has a core-shell structure.

The host crystal and junction crystal forming a junction-structure grain can, of course, be made of different silver halides. Further, one of these crystals can be made of a silver salt compound (non-rocksalt structure), such as silver rhodanide and silver carbonate, provided that it can be attached to the crystal which is made of silver halide.

In the case of silver bromoiodide grains having the core-shell structure, it is desirable that the core contain more silver iodide than the shell. In some cases, the core should better contain less silver iodide than the shell. As for silver iodide grains having the junction structure, it is desirable that the host crystal contains more silver iodide than the junction crystal in some cases, and less silver iodide than the junction crystal in other cases. In either a core-shell grain or a junction-structure grain, the two components can have a distinct boundary and an indistinct boundary. Alternatively, the boundary between the two components can have a composition which gradually changes from one component to the other.

When the silver halide grains used are those formed of two or more silver halides which are present in the form of a mixed crystal or a core-shell structure, it is important to control the halogen distribution among the grains. A method of measuring the halogen distribution is disclosed in JP-A-60-254032. The more uniform the halogen distribution among the grains, the better. An silver halide emulsion containing grains whose variation coefficient is 20% or less is particularly desirable. Another preferable emulsion is one in which the grain size is correlated to the halogen composition of the grain, more specifically the iodine content of each grain is correlated to its size. A silver halide emulsion can be used in which the iodide content of each grain is inversely correlated to the grain size, or in which the grain size and the content of any other halogen are correlated, in accordance with the use of the light-sensitive material. In view of this it would be recommendable that two or more emulsions having different composition be mixed and used.

It is also essential to control the halogen composition in the near-surface region of the grain. More specifically, the content of silver iodide or silver chloride in the near-surface region should be increased to change the dye-adsorbing efficiency or developing speed of the grain, in accordance of the use of the light-sensitive material. In order to change the halogen composition in the near-surface region, a layer can be formed, either covering the entire grain or adhering only part of the grain. In the case of a tetradecahedral grain having a (100) face and a (111) face, the halogen composition is changed in one surface only. In the case of a tabular grain, the halogen composition is changed in either one major surface or one side.

Tabular grains can be prepared by the methods disclosed in Cleve, "Photography Theory and Practice" (1930), p. 131, Gutoff, "Photographic Science and Engineering," Vol. 14, pp. 248–257 (1970), U.S. Pat. Nos. 4,434,226, 4,414,310, 4,433,048 and 4,439,520, and British Patent 2,112,157. As is described in U.S. Pat. No. 4,434,226, the use of tabular grains improves the covering power and enhance the efficiency of spectral sensitization achieved by a sensitizing dye. Triangular, hexagonal, or circular tabular grains can be used. Preferable tabular grains are hexagonal grains having six sides having substantially the same length, as is disclosed in U.S. Pat. No. 4,797,354.

In most cases, the size of grains is represented in terms of equivalent-circle diameter, i.e., the diameter of a circle having the same area as the projected image of the grain. Grains having an average diameter of 0.6 microns or less, such as those disclosed in U.S. Pat. No. 4,748,106, are desirable to provide silver halide emulsion which serves to form high-quality images. An emulsion having a narrow grain-size distribution, such as the emulsion disclosed in U.S. Pat. No. 4,775,617 is preferred. An emulsion containing tabular grains which have a thickness of 0.5 microns or less, preferably 0.3 microns or less, is desirable since it serve to provide photographic light-sensitive material which has improved sharpness. Also desirable is an emulsion containing tabular grains which have a thickness-variation coefficient is only 30% or less. The emulsion disclosed in JP-A-63-163451 is also preferred which contains grains whose twin faces are spaced part by a specific distance.

The silver halide grains for use in this invention can be those which have been rounded by the process disclosed in European Patents 96,727B1 and 64,412B1, or those which have been surface-modified as is disclosed in west Germany Patent 2,306,447C2, or JP-A-60-221320.

Grains having flat surfaces are generally used. Nonetheless, grains having concaves in their surfaces can be used for a specific purpose. Methods of making holes in a selected portion of a crystal (e.g., an apex or the center of the surface) are described in JP-A-58-106532 and JP-A-60-221320. An example of such grains are the ruffled grains disclosed in U.S. Pat. No. 4,643,966.

The grain size of the emulsion according to the invention can be evaluated in terms of equivalent-circle diameter determined from the projected grain area measured by means of an electron microscope, in terms of equivalent-sphere diameter determined from the grain volume calculated from the projected grain area and the grain thickness, or in terms of equivalent-sphere diameter determined by a colter counter method. Grains of various sizes can be used, ranging from fine grains having an equivalent-sphere diameter of 0.05 μm or less, to coarse grains having an equivalent-sphere diameter of 10 μm or more. Preferable grains are light-sensitive silver halide grains which have an equivalent-sphere diameter of 0.1 to 3 μm.

The emulsion according to the invention can either be a polydisperse one containing grains having a broad size distribution, or a monodisperse one containing grains having a narrow size distribution. As the scale of size distribution, a variation coefficient of equivalent-circle diameter determined from the projected grain area or a variation coefficient of equivalent-sphere diameter determined from the grain volume can be used. Preferable monodisperse emulsions have a variation coefficient of 25% or less, more preferably 20% or less, still more preferably 15% or less.

Also preferable is a monodisperse emulsion containing grains whose size distribution is such that at least 80% (in number or weight) of all grains deviate from the average size, but within ±30% thereof. In order to provide a light-sensitive material which has satisfactory gradation, monodisperse silver halide emulsions having different grain sizes can be coated, in the form of a mixture, thus forming a emulsion layer having a specific color sensitivity, or can be coated separately, thus forming emulsion layers having substantially the same color sensitivity. For the same purpose, polydisperse silver halide emulsions having different grain sizes can be coated, in the form of a mixture, thus forming a emulsion layer having a specific color sensitivity, or can be coated separately, thus forming emulsion layers having substantially identical color sensitivity. Moreover, at least one monodisperse silver halide emulsion and at least one polydisperse silver halide emulsion can be coated, in the form of a mixture, thus forming a emulsion layer having a specific color sensitivity, or can be coated separately, thus forming emulsion layers having substantially the same color sensitivity.

The photographic emulsion for use in the present invention can be prepared by methods described in, for example, P. Glafkides, "Chimie et Physique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. In other words, the emulsion can be prepared by acid method, neutral method, or ammonia method. To react a soluble silver salt with soluble halogen salt, one-side mixing or simultaneous mixing, or both can be employed. Silver halide grains can be formed by means of so-called "reverse mixing," in which the grains are formed in the presence of an excessive amount of silver ions.

One of the simultaneous mixing methods is so-called "controlled double-jet method." In this method, pAg in the liquid phase in which to form silver halide grains is maintained at a prescribed value. This method can be used in this invention, thereby to obtain silver halide grains which have a regular crystal shape and a virtually uniform size.

Methods of preparing emulsions, in which silver halide grains formed by precipitation are added into a reaction vessel are preferred in some cases. Such methods are disclosed in, for example, U.S. Pat. Nos.

4,334,012, 4,301,241, and 4,150,994. By these methods, the grains can well applied as seed crystals, or as grains to grow. If the grains are to be grown in the reaction vessel, they should better be small. The grains can be introduced into the vessel, all at a time, in portions at several times, or little by little continuously. In some cases, it is recommendable that grains of different halogen compositions be added in order to modify the surface.

Methods of changing the halogen composition in part or whole of a silver halide grain by halogen conversion method are known, as is disclosed in U.S. Pat. Nos. 3,477,852 and 4,142,900, European Patents 273,429 and 273,430, and West German Laid-open Application 3,819,241. These are also useful methods of forming grains. Solution of soluble halogen or silver halide grains can be into a reaction vessel, thereby to form slightly soluble silver salt. The halogen composition of the grain can be converted all at a time, in portions at several times, or little by little continuously.

Generally, grains are grown by feeding soluble silver salt and halogen salt into the reaction vessel, each in constant density and at constant speed. Other methods of growing grains, in which silver salt and halogen salt are fed in a varying density or at a changing speed, are also preferable. Such methods are described in British Patent 1,469,480, U.S. Pat. Nos. 3,650,757 and 4,242,445. If the grains are fed in an increased density or at an increased speed, the amount added will increase with the time of feeding the grains according to linear function, quadratic function, or more complicated function. It would be better to reduce the amount of silver halide used, as is required in some cases. In the case where two or more solutions of soluble halogen salts, which differ in composition, are added, as an example, the bromide content can be increased and the iodide content can be used decreased, or vice versa.

To react the solution of soluble silver salt with that of soluble halogen salt, the known method can be employed. Examples of this method are disclosed in U.S. Pat. Nos. 2,996,287, 3,342,605, 3,415,650 and 3,785,777, and West German Laid-open Patent Applications 2,556,885 and 2,555,364.

Solvents for dissolving silver halide are useful for accelerating the ripening. As known in the art, an excessive amount of halogen ions is introduced in the reaction vessel, thereby to accelerate the ripening. Any other ripening agent can be used for the same purpose. The ripening agent can be applied in various manners. For example, it is added to the dispersion medium contained in the reaction vessel, before silver salt and halogenide salt are introduced into the vessel. Alternatively, it can be introduced into the reaction vessel, along with halogenide salt, silver salt, and deflocculant. Still alternatively, it can be introduced into the vessel independently of the halogenide salt and the silver salt.

Examples of such solvents are: ammonia; thiocyanate (e.g., potassium rhodanide or rhodan ammonium); organic thioether compound (e.g., those disclosed in U.S. Pat. Nos. 3,574,628, 3,021,215, 3,057,724, 3,038,805, 4,276,374, 4,297,439, 3,704,130 and 4,782,013, JP-A-57-104926); thione compound (e.g., tetra-substituted thiourea disclosed in JP-A-53-82408, JP-A-55-77737, and U.S. Pat. No. 4,221,863, or the compound disclosed in JP-A-53-144319); mercapto compound (e.g., the compound disclosed in JP-A-57-202531 which can accelerate the growth of silver halide grains); and amine compound (e.g., the compound disclosed in JP-A-54-100717).

Gelatin is suitable for use in the emulsion of the invention, as protective colloid and as binder in a layer made of any other hydrophilic colloid layer. Also, any other hydrophilic colloid can be used. Examples of other hydrophilic colloid are: proteins such as graft polymer of gelatin derivatives or gelatin and high-molecular substance, albumin, and casein; cellulose derivatives such as hydroxyethyl cellulose, carboxymethyl cellulose, and cellulose deviatives such as cellulose sulfate ester; sugar derivatives such as sodium arginate and starch derivative; and synthetic hydrophilic high-molecular substances such as monomer and polymer (e.g., polyvinyl alcohol, polyvinyl alcohol partial acetal, poly-N-vinylpyrrolidone, polyacrylic acid, polymethacrylate, polyacrylamide, polyvinylimidazole and polyvinylpyrazole).

Gelatin can not only be lime-treated gelatin, but also acid-treated gelatin or such an enzyme-treated gelatin as is disclosed in Bull. Soc. Sci. Photo. Japan, No. 16, p. 30 (1966). Also, a substance obtained by hydrolyzed gelatin or by decomposed gelatin with an enzyme.

It is desirable that the emulsion of the invention be washed with water to be desalted and then be dispersed in a protective colloid newly prepared. The emulsion can be water-washed at any temperature selected in accordance with its use, but preferably at 5° C. to 50° C. It can be water-washed at any pH value selected for its application, but preferably at a pH value ranging from 2 to 10, more preferably at a pH value ranging from 3 to 8. Also, any value can be selected for the pAg at the time of the water-washing, in accordance with the use of the emulsion, but a preferable pAg value is 5 to 10. Further, the emulsion can be washed with water by any known method, such as Nudle water-washing, dialysis by semipermeable membrane, centrifugal separation, aggregation sedimentation, or ion exchange. In the case of aggregation sedimentation, use can be made of a sulfate, an organic solvent, a water-soluble polymer, or a gelatin derivative.

It is desirable, depending on the use of the emulsion, that metal ions be present during the forming of grains, the desalting, or the chemical sensitization, or before the coating of the emulsion. To dope the metal ions in the grains, the ions should better be added at the forming of the grains. To use the ions to modify the grain surface or as chemical sensitizer, they should be better be added after the forming of the grains and before the completion of the chemical sensitization. Metal ions can be doped in the entire grain, in only the core thereof, in only the shell thereof, or in only the epitaxial portion thereof, or only the substrate grain only. Examples of the metal are: Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi, and the like. These metals can be added in the form of any salt that can be dissolved during the forming of the grains, such as ammonium salt, acetate, nitrate, sulfate, phosphate, hydroxide, six-coordinated complex, or four-coordinated complex. Specific example of this salt are: $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$, and the like. The ligand of coordination compound can be selected from the group consisting of halo, aquo, cyano, cyanate, thiocyanate, nitrosyl, thionitrosyl, oxo, and carbonyl. Only one of these metal compounds is used, or two or three, or more of these can be used in combination.

It is desirable that the metal compound or compounds be dissolved in an appropriate solvent such as methanol or acetone, and the resultant solution be added to the emulsion. To stabilize the solution, aqueous solution of a hydrogen halide (e.g., HCl or HBr), or alkali halide (e.g., KCl, NaCl, KBr, or NaBr) can be added to the solution. Further, acid or alkali can be added to the solution, if necessary. The metal compounds can be supplied into the reaction vessel, either before or during the forming of the silver halide grains. Alternatively, the metal compounds can be added to aqueous solution of a water-soluble silver salt (e.g., $AgNO_3$) or a alkali halide (e.g., NaCl, KBr or KI), and the resultant solution can be continuously supplied into the reaction vessel during the forming of the silver halide grains. Also, a solution containing the metal compounds can be prepared and continuously introduced into the reaction vessel during a proper stage of the grain-forming period. It is also preferable that the metal compounds be added by a combination of various methods.

A method in which chalcogen is added during the forming of the grains is useful in some cases. Such a method is disclosed in U.S. Pat. No. 3,772,031.

According to the invention, silver halide grains can be added at any time during the preparation of the emulsion. Preferably, two or more sensitizations are utilized in combination. The sensitization or sensitizations can be performed at various times, thereby preparing emulsions of different types. Among these types of emulsions are: an emulsion which contains grains each having chemically sensitizing nuclei in the internal part; an emulsion which contains grains each having chemically sensitizing nuclei in the near-surface region; and an emulsion which contains grains each having chemically sensitizing nuclei in the surface. Of these emulsions, one containing grains each having chemically sensitizing nuclei of at least one type embedded in the near-surface region.

Preferably, the silver halide emulsion is subjected to reduction sensitization, during the forming of grains, after the forming of grains but before the chemical sensitization, during the chemical sensitization, or after the chemical sensitization.

The reduction sensitization can be a method in which a reduction sensitizer is added to the silver halide emulsion, silver ripening in which the emulsion is ripened in a low-pAg atmosphere having a pAg value ranging from 1 to 7, or high-pH ripening in which the emulsion is ripened in a high-pH atmosphere having a pH value ranging from 8 to 11. Two or all of these methods can be used in combination. Of these methods, the method of adding a reduction sensitizer to the emulsion is preferable in that the level of reduction sensitization can be adjusted minutely.

Examples of the reduction sensitizer are known compounds such as stannous salt, ascorbic acid, derivative thereof, amine, polyamines, hydrazine derivative, formamidine sulfinic acid, silane compound, and borane compound. One or more of these reduction sensitizers can be selected and used in the present invention. Of these, preferable for use in this invention are: stannous chloride, thiourea dioxide, dimethylamine borane, ascorbic acid, and derivatives thereof. The amount in which to add the reduction sensitizer or sensitizers depends on the conditions in which the emulsion is manufactured. A suitable amount is $10^{-7}$ to $10^{-3}$ mol per mol of silver halide.

The reduction sensitizer is first dissolved in a solvent such as alcohols, glycols, ketones, esters, or amides, and are then added, in the form of a solution, while the grains are growing. The sensitizer can be applied into the reaction vessel before the growth of the grains, but it should better be added at a proper stage during the growth of the grains. Another method applicable is to add the reduction sensitizer an aqueous solution of silver salt or water-soluble alkali halide, and to apply the resultant solution, thereby precipitating silver halide grains. Also, a solution of the reduction sensitizer can be added, either in several portions, or continuously over a long time.

It is desirable that an oxidizing agent be used for oxidizing silver during the preparation of the emulsion. The oxidizing agent for silver is a compound which acts on silver, thus forming silver ions. Effective as such an oxidizing agent are compounds which convert the fine silver grains formed during the forming of silver halide grains or the chemical sensitization thereof, into silver ions. The silver ions, thus formed, can form a slightly soluble silver salt, such as silver halide, silver sulfate, and silver selenide. Also the silver ions can form a water-soluble silver salt such as silver nitrate. The oxidizing agent for silver can be an inorganic one or an organic one.

Examples of the inorganic oxidizing agent are; ozone, hydrogen peroxide, adduct thereof (e.g., $NaBO_2.H_2O_2.3H_2O$, $2NaCO_3.3H_2O_2$, $Na_4P_2O_7.2H_2O_2$, or $2Na_2SO4.H_2O_2.2H_2O$), peroxy acid salt (e.g., $K_2S_2O_8$, $K_2C_2O_6$, or $K_2P_2O_8$), peroxy complex compound (e.g., $K_2(Ti(O_2)C_2O_4).3H_2O$, $4K_2SO_4.Ti(O_2)OH.SO_4.2H_2O$, or $Na_3(VO(O_2)(C_2H_4)_2).6H_2O$), oxyacid salt such as permanganate (e.g., $KMnO_4$) or chromate (e.g., $K_2Cr_2O_7$), halogen element such as iodine or bromine, perhalogenate (e.g., potassium perhaloganate), salt of high-valence metal (e.g., potassium hexacyanoferrate (II), and thiosulfonate.

Examples of the organic oxidizing agent are: quinones such as p-quinone, organic peroxides such as peracetic acid or perbenzoic acid, compounds releasing active halogen (e.g., N-bromosuccinimide, chloramine-T, and chloramine-B).

Preferable as oxidizing agent for use in this invention are: ozone, hydrogen peroxide, adduct thereof, halogen element and thiosulfonate, which are inorganic oxidizing agents, and quiones which are organic oxidizing agents.

It is preferable that the reduction sensitizer and the oxidizing agent for silver be used together. The reduction sensitizer can be added before or after the oxidizing agent for silver is applied, or simultaneously with the oxidizing agent for silver. The reduction sensitizer and the oxidizing agent for silver can be applied during the forming of the grains or during the chemical sensitization.

The photographic emulsion used in the invention can contain various compounds to prevent fogging from occurring during the manufacture, storage or processing of the light-sensitive material, and to stabilize the photographic properties of the light-sensitive material. More precisely, compounds known as antifoggants and stabilizers can be added to the emulsion. Examples of these compounds are: thiazoles such as benzothiazolium salt; nitroimidazoles; nitrobenzimidazoles; chlorobenzimidazoles; bromobenzimidazoles; mercapto thiazoles;

mercapto benzothiazoles; mercapto benzimidazoles; mercapto thiadiazoles; aminotriazoles; benzotriazoles; nitrobenzotriazoles; mercapto tetrazoles, particularly, 1-phenyl-5-mercapto tetrazole; mercapto pyrimidines; mercapto triazines; thioketo compounds such as oxadolinethione; azindines such as triazinedine and tetraazinedine (particularly, 4-hydroxy-substituted (1, 3, 3*a*, 7) tetraazinedines); pentaazindines. The compounds disclosed in, for example, U.S. Pat. Nos. 3,954,474 and 3,982,947 and JP-B-52-28660 can be used as antifoggants and stabilizers. One of compounds which are preferable for use in the invention is disclosed in JP-A-62-47225.

These antifoggants and stabilizers can be added before, during or after the forming of grains, during water-washing, during the dispersion process subsequent to the water-washing, before, during or after chemical sensitization, or before coating process, in accordance with the purpose for which the antifoggants and the stabilizers are used. The antifoggants and the stabilizers can be used, not only to prevent fogging and stabilize the photographic properties of the light-sensitive material, but also to control the crystal habit of the grain, reduce the grain size, decrease the solubility of the grain, control the chemical sensitization, and modify the arrangement of dye particles.

It is desirable that the photographic emulsion used in the invention be spectrally sensitized with methine dyes or the like. Examples of the dyes used are: cyanine dye, melocyanine dye, composite cyanine dye, composite melocyanine dye, holopolar cyanine dye, hemicyanine dye, styryl dye, and hemioxonol dye. Of these dyes, particularly useful are cyanine dye, melocyanine dye, and composite melocyanine dye. These dyes contains nuclei which are usually used in cyanine dyes as basic heterocyclic nuclei. Examples of the nuclei are nuclei such as pyrroline, oxazoline, thiozoline, pyrrole, oxazole, thiazole, selenazole, imidazole, teterazole, and pyridine; nuclei each formed of any one of these nuclei and an alicylic hydrocarbon ring fused to the nucleus; and nuclei each formed of any one of these nuclei and an aromatic hydrocarbon ring fused to the nucleus, such as indolenine, benzindolenine, indole, benzoxadole, naphthoxazole, benzothiazole, naphthothiazole, benzoselenazole, benzimidazole, and quinoline. These nuclei can be substituted at carbon atoms.

Melocyanine dye or composite melocyanine dye can one which has nuclei of ketomethylene structure. Applicable as such nuclei are 5- or 6-membered heterocyclic nuclei of pyrazoline-5-on, thiohydantoin, 2-thiooxazoline-2,4-dione, thiazolidine-2,4-dione, rhodanine or thiobarbituric acid.

These sensitizing dyes can be used, either singly or in combination. In many cases, they are used in combination, for achieving supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, and JP-A-52-109925.

According to the present invention, the emulsion can contain not only the sensitizing dye, but also a dye which has no sensitizing ability or a substance which absorbs virtually no visible light and has supersensitizing ability.

The sensitizing dye can be added at any time during the preparation of any emulsion that has been hitherto known as useful. In most cases, the dye is added after the chemical sensitization and before the coating of the emulsion. It can be added at the same time the chemical sensitizer is added, thereby to accomplish spectral sensitization and chemical sensitization at the same time, as is disclosed in U.S. Pat. Nos. 3,628,969 and 4,225,666. Alternatively, it can be added before the chemical sensitization, to initiate spectral sensitization, as is described in JP-A-58-113928. Also, it can be added before the precipitation of silver halide grains, to initiate spectral sensitization. Still alternatively, it can be added in two portions before and after chemical sensitization, respectively, as is disclosed in U.S. Pat. No. 4,225,666. Moreover, it can be added at any time during the forming of silver halide grains, as is described in U.S. Pat. No. 4,183,756.

The amount in which to add the sensitizing dye is $4\times10^{-6}$ to $8\times10^{-3}$ mol per mol of silver halide used. Preferably, the dye is added in an amount of $5\times10^{-5}$ to $2\times10^{-3}$ mol per mol of silver halide, in the case the silver halide grains used have sizes ranging from 0.2 to 1.2 $\mu$m.

The silver halide emulsion layers of the photographic light-sensitive material according to this invention contains 50 wt % to 100 wt %, preferably 80 wt % to 100 wt % of the silver halide grains according to the invention.

Not only the additives described above, but also other additives are used in the light-sensitive material according to the invention, in accordance to the application of the material. These additives are described in Research Disclosure Item 17643 (December 1978), Research Disclosure Item 18716 (November 1979), and Research Disclosure Item 307105 (November 1989), as is listed in the following table:

| Additives | RD17643 | RD18716 | RD307105 |
|---|---|---|---|
| 1. Chemical sensitizers | page 23 | page 648, right column | page 996 |
| 2. Sensitivity increasing agents | | page 648, right column | |
| 3. Spectral Sensitizers, super sensitizers | pp. 23–24 | page 648, right column to page 649, right column | page 996, right column to page 998, right column |
| 4. Brighteners | page 24 | | page 998, right column |
| 5. Antifoggants and stabilizers | pp. 24–25 | page 649, right column | page 998, right column to page 1000, right column |
| 6. Light absorbent, filter dye, ultraviolet absorbents | pp. 25–26 | page 649, right column to page 650, left column | page 1003, left column to page 1003, right column |
| 7. Stain preventing | page 25, | page 650, left to | |

-continued

| Additives | RD17643 | RD18716 | RD307105 |
|---|---|---|---|
| agents | right column | right columns | |
| 8. Dye image stabilizer | page 25 | | |
| 9. Hardening agents | page 26 | page 651, left column | page 1004, right column to page 1005, left column |
| 10. Binder | page 26 | page 651, left column | page 1003, right column to page 1004, right column |
| 11. Plasticizers, lubricants | page 27 | page 650, right column | page 1006, left column to page 1006, right column |
| 12. Coating aids, surface active agents | pp. 26–27 | page 650, right column | page 1005, left column to page 1006, left column |
| 13. Antistatic agents | page 27 | page 650, right column | page 1006, right column to page 1007, left column |

The present invention will be described in more detail below by way of its examples, but the present invention is not limited to these examples.

EXAMPLE 1

(Preparation of Emulsion Em-A)

First, 1000 ml of aqueous solution containing 10.5 g of gelatin and 3.0 g of KBr was stirred, while maintained at 60° C. Next, aqueous solution of silver nitrate (8.2 g of $AgNO_3$) and aqueous solution of halides (5.7 g of KBr and 0.35 g of KI) were added to the solution over 1 minutes by means of double-jet method. The resultant solution was heated to 75° C., and aqueous solution of silver nitrate (136.3 g of $AgNO_3$) and aqueous solution of halides (containing 4.2 mol % of KI based on the amount of KI used) were added to the solution over 51 minutes by means of double-jet method, gradually increasing the flow rates. In the process, the silver potential was maintained at 0 mV with respect to the saturated calomel electrode. Thereafter, the resultant solution was cooled to 40° C., and aqueous solution of silver nitrate (28.6 g of $AgNO_3$) and KBr aqueous solution were added to the solution over 5.35 minutes by means of double-jet method, while maintaining the silver potential at −50 mv with respect to the saturated calomel electrode. As a result, an emulsion was formed. The emulsion was desalted by means of flocculation. Gelatin was added to the emulsion, and the pH value and pAg value of the emulsion were adjusted to 5.5 and 8.8, respectively, thus preparing Emulsion Em-A. Emulsion Em-A contained tabular grains which had an average equivalent-circle diameter of 1.14 μm, an average thickness of 0.189 μm, an average aspect ratio of 6.03, and a variation coefficient of 28% (in terms of equivalent-circle diameter).

(Preparation of Emulsion Em-B)

Emulsion Em-B was prepared in the same method as 10 Emulsion Em-A, except that after the solution was cooled to 40° C., aqueous solution of silver nitrate (3.2 g of $AgNO_3$) and KI aqueous solution (2.3 g of KI) were added to the solution over 5 minutes. Then aqueous solution of silver nitrate (25.4 g of $AgNO_3$) and KBr aqueous solution were added to the solution over 5.35 minutes by means of double-jet method, while maintaining the silver potential at −50 mV with respect to the saturated calomel electrode, thereby forming an emulsion. Thereafter, the emulsion was desalted, gelatin was added to the emulsion, and the pH value and pAg value of the emulsion were adjusted—all in the same conditions as in the preparation of Emulsion Em-A —, whereby Emulsion Em-B was prepared. Emulsion Em-B contained tabular grains which had an average equivalent-circle diameter of 1.09 μm, an average thickness of 0.196 μm, an average aspect ratio of 5.56, and a variation coefficient of 29% (in terms of equivalent-circle diameter).

(Preparation of Emulsion Em-C)

First, 1% by volume of ammonia was added to gelatin solution containing potassium bromide, while maintaining the gelatin solution at 65° C. Thereafter, aqueous solution of silver nitrate, and aqueous solution containing potassium iodide and potassium bromide in an amount ratio of 3:97, were added to the gelatin solution by means of so-called "controlled double-jet method," while stirring the gelatin solution and maintaining the pAg value of the solution at 7.9. When the amount of silver nitrate added reached to 54% of the total amount to be used, the pAg value was adjusted to 8.2. Then, the remaining portion of the silver nitrate solution was added by means of the controlled double-jet method.

The resultant solution was desalted by the ordinary method. Next, 60 g of gelatin was added per mol of silver. The pH value and pAg value of the solution was adjusted to 6.3 and 8.4, respectively, at the temperature of 40° C., thereby preparing Emulsion Em-C. Emulsion Em-C contained octahedral silver bromoiodide grains having an average size of 0.90 μm and containing 3 mol % of silver iodide.

(Preparation of Emulsion Em-D)

First, 1% by volume of ammonia was added to gelatin solution containing potassium bromide, while maintaining the gelatin solution at 65° C. Thereafter, aqueous solution of silver nitrate, and aqueous solution containing potassium iodide and potassium bromide in an amount ratio of 3:97, were added to the gelatin solution by means of the controlled double-jet method, while stirring the gelatin solution and maintaining the pAg value of the solution at 7.9, until the amount of silver nitrate added reached to 41% of the total amount to be used.

Thereafter, the aqueous solution of silver nitrate, and aqueous solution containing potassium iodide and potassium bromide in an amount ratio of 38:62, were added to the gelatin solution by means of the controlled double-jet method, while stirring the gelatin solution and maintaining the pAg value of the solution at 7.7, until the amount of silver nitrate added reached to 13% of the total amount to be used.

Further, the aqueous solution of silver nitrate, and aqueous solution of potassium bromide were added to the gelatin solution by means of the controlled double-jet method, while stirring the gelatin solution and maintaining the pAg value of the solution at 8.2, until the amount of silver nitrate added reached to 46% of the total amount to be used.

The resultant solution was desalted by the ordinary method. This done, 60 g of gelatin was added per mol of silver. The pH value and pAg value of the solution was adjusted to 6.8 and 8.4, respectively, at the temperature of 40° C., thereby preparing Emulsion Em-D. Emulsion Em-D contained octahedral silver bromoiodide grains having an average size of 0.90 μm. Each of these grains was formed of a core made of silver iodobromide, occupying 46 wt % and containing 3 mol of silver iodide, the first shell made of silver iodobromide, occupying 8 wt % and containing 38 mol of iodobromide, and the second shell made of silver bromide and occupying 46 wt %.

Emulsions Em-A to Em-D, thus prepared, were examined by means of a 200 KV transmission electron microscope at the liquid-helium temperature. No dislocation lines were observed in almost all grains contained in Emulsion Em-A. On the other hand, many, dislocation lines were found in the entire surfaces of the tabular grains contained in Emulsion Em-B. The grains contained in Emulsions Em-C and Em-D were so thick that the electron microscope failed to determine whether or not they had dislocation lines. Hence, the grains were etched and examined by means of the electron microscope. Although the dislocation lines the grains contained Emulsion Em-B and Em-D had could not counted with accuracy, it was obvious that the grain had 10 or more dislocation lines.

Figure 2:
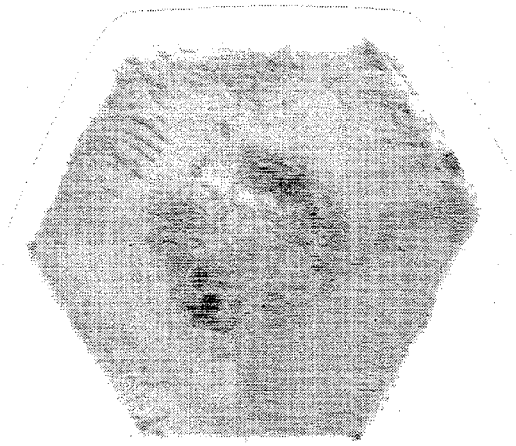
FIG. 2 is a photograph taken by a transmission electron microscope at magnification of 40,000, showing the grains contained in emulsion Em-B according to the present invention.

FIGS. 1 and 2 are microscope photographs of Emulsions Em-A and Em-B, respectively. As is evident from these figures, the grains in Emulsion Em-A have no dislocation lines, whereas those of Emulsion Em-B have dislocation lines.

Emulsions Em-A to Em-D were subjected to gold-sulfur sensitization in the following way. First, each emulsion was heated to 72° C. Next, sensitizing dye Dye-1, antifoggant V-1, sodium thiosulfate, chloroauric acid, and potassium thiocyanate were sequentially added to the emulsion, in amounts of $1\times10^{-3}$ mol/mol Ag, $7\times10^{-5}$ mol/mol Ag, $1.1\times10^{-5}$ mol/mol Ag, $1.0\times10^{-5}$ mol/mol Ag, and $8.0\times10^{-4}$ mol/mol Ag, respectively. The emulsion was thereby chemical-sensitized optimally. The phrase "chemical-sensitized optimally" means that the emulsion exhibits the highest sensitivity when it is exposed to light for 1/10 second after it has been chemically sensitized.

The sensitizing dye Dye-1 and the antifoggant V-1 are represented by the following formulas:

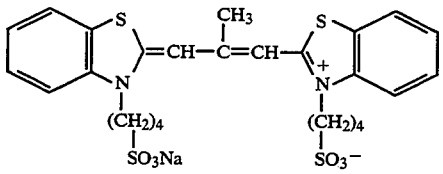

Dye-1

-continued

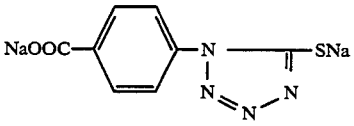

V-1

Also, Emulsions Em-A to Em-D were subjected to gold-sulfur-tellurium sensitization in the following way. First, each emulsion was heated to 72° C. Next, sensitizing dye Dye-1, antifoggant V-1, sodium thiosulfate, chloroauric acid, potassium thiocyanate, and butyldiisopropyl phosphinetelluride were sequentially added to the emulsion, in amounts of $1\times10^{-3}$ mol/mol Ag, $1\times10^{-4}$ mol/mol Ag, $1.0\times10^{-5}$ mol/mol Ag, $1.5\times10^{-5}$ mol/mol Ag, $2.4\times10^{-3}$ mol/mol Ag, and $1.0\times10^{-5}$ mol/mol Ag, respectively.

Eight types of photographic light-sensitive materials (hereinafter referred to as "Samples 1 to 8") were prepared, each by coating a plurality of layers having the following compositions, sequentially one upon another, on a triacetylcellulose film support. The second emulsion layer (i.e., layer 2) of each sample was formed of Emulsion Em-A, Em-B, Em-C, or Em-D.

| | |
|---|---|
| (Lowermost layer) | |
| Binder: gelatin | 1 g/m² |
| Fixing accelerator: E-1 | |
| E-1 | |

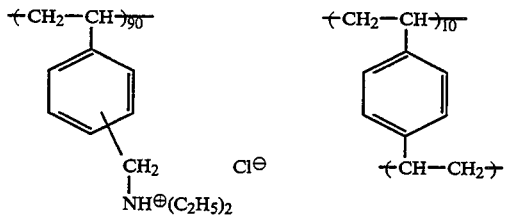

| | |
|---|---|
| (Emulsion layer 1: Containing spherical monodisperse AgBrI grains having an equivalent-circle diameter of 0.4 μm, a variation coefficient of 13%, and iodide content of 3 mol %) | |
| Silver | 1.5 g/m² |
| Binder: gelatin | 1.6 g/Ag 1 g |
| Sensitizing dye: | |

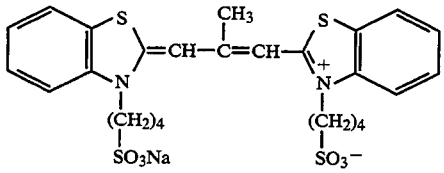

| | |
|---|---|
| Additive: | |
| $C_{18}H_{35}O(CH_2CH_2O)_{20}-H$ | 5.8 mg/Ag 1 g |
| Coating aids: | |
| Sodium dodecylbenzenesulfonate | 0.07 mg/m² |
| Potassium poly-p-styrenesulfonate | 0.7 mg/m² |
| (Emulsion layer 2) | |
| Silver | 4.0 g/m² |
| Binder, additive, coating aids | Same as layer 1 |
| (Protective layer) | |
| Binder: gelatin | 0.7 g/m² |
| Coating aid: | 0.2 mg/m² |
| Sodium N-oleoyl-N-methyltaurate | |
| Matting agent: | 0.13 mg/m² |
| Polymethylmethacrylate powder | |

-continued

| | |
|---|---|
| (average size: 3 μm) | |

Samples 1 to 8 were left to stand at 25° C. at relative humidity of 65% for 7 days after they had been prepared. Then, these samples were exposed, for 1/10 second, to the light applied through a continuous wedge from a tungsten-filament bulb (color temperature: 2854 K). They were developed with developing solution D-76 at 20° C. for 7 minutes, fixed with a fixing solution (Fujifix manufactured by Fuji Film Co., Ltd.), washed with water, and finally dried.

The sensitivities of Samples 1 to 8 were evaluated in the reciprocal of the exposure amount each emulsion required to have an optical density of fog +0.1. Also, the RMS graininess of each sample was measured by the method described in "The Theory of the Photographic Process," Macmillan, Inc., p. 619, after the sample had been uniformly exposed to have a density of fog +0.5 and developed under the conditions specified above.

The results were as is shown in the following Table 1.

TABLE 1

| Sample | | Em | Grain shape | Dislocation Lines | Chemical Sensitization | Relative Sensitivity | Fog | Relative graininess |
|---|---|---|---|---|---|---|---|---|
| 1 | Comparative Example | A | Tabular | to 0 | Gold—Sulfur | 100 | 0.14 | 100 |
| 2 | Comparative Example | A | Tabular | to 0 | Gold—Sulfur—Tellurium | 114 | 0.18 | 104 |
| 3 | Comparative Example | B | Tabular | 10 or more | Gold—Sulfur | 121 | 0.16 | 97 |
| 4 | Present Invention | B | Tabular | 10 or more | Gold—Sulfur—Tellurium | 143 | 0.14 | 94 |
| 5 | Comparative Example | C | Octahedral | to 0 | Gold—Sulfur | 100 | 0.14 | 100 |
| 6 | Comparative Example | C | Octahedral | to 0 | Gold—Sulfur—Tellurium | 118 | 0.17 | 106 |
| 7 | Comparative Example | D | Octahedral | 10 or more | Gold—Sulfur | 114 | 0.16 | 98 |
| 8 | Present Invention | D | Octahedral | 10 or more | Gold—Sulfur—Tellurium | 139 | 0.14 | 92 |

Note:
The sensitivity and graininess of Sample 1 were used as reference for those of Samples 2 to 4, whereas the sensitivity and graininess of Sample 5 for those of Samples 6 to 8. The greater the number, the higher the relative sensitivity; the less the number, the higher the relative graininess.

As can be clearly understood from Table 1, the emulsions used in Samples 4 and 8, both according to the present invention, had high sensitivity and low fog, demonstrating the advantages of the present invention.

EXAMPLE 2

A plurality of layers having the following compositions were coated on an undercoated triacetylcellulose film support, forming a multi-layer color light-sensitive material (hereinafter referred to as "Sample 101").

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer.

| | |
|---|---|
| Layer 1: Antihalation layer | |
| Black colloidal silver | silver 0.18 |
| Gelatin | 1.40 |
| Layer 2: Interlayer | |
| 2,5-di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Layer 3: 1st red-sensitive emulsion layer | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Layer 4: 2nd red-sensitive emulsion layer | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Layer 5: 3rd red-sensitive emulsion layer | |
| Emulsion Em-A | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |
| Gelatin | 0.80 |
| Layer 7: 1st green-sensitive emulsion layer | |
| Emulsion A | silver 0.15 |
| Emulsion B | silver 0.15 |

-continued

| | |
|---|---|
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Layer 8: 2nd green-sensitive emulsion layer | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Layer 9: 3rd green-sensitive emulsion layer | |
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Layer 10: Yellow filter layer | |
| Yellow colloidal silver | silver 0.050 |
| EX-5 | 0.080 |
| HBS-1 | 0.030 |
| Gelatin | 0.95 |
| Layer 11: 1st blue-sensitive emulsion layer | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.042 |

-continued

| | |
|---|---|
| EX-9 | 0.72 |
| HBS-1 | 0.28 |
| Gelatin | 1.10 |
| Layer 12: 2nd blue-sensitive emulsion layer | |
| Emulsion G | silver 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Layer 13: 3rd blue-sensitive emulsion layer | |
| Emulsion H | silver 0.77 |
| Sensitizing dye VII | $2.2 \times 10^{-4}$ |
| EX-9 | 0.20 |
| HBS-1 | 0.070 |
| Gelatin | 0.69 |
| Layer 14: 1st protective layer | |
| Emulsion I | silver 0.20 |
| U-4 | 0.11 |
| U-5 | 0.17 |
| HBS-1 | $5.0 \times 10^{-2}$ |
| Gelatin | 1.00 |
| Layer 15: 2nd protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, all layers of Sample 101 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they could have improved storage stability, processing ability, pressure-resistive property, antibacterical property, antifungal property, antistatic property, and coating property.

The particulars of the emulsions used will be shown in Table 2, and the compounds used will be specified by the following formulas:

TABLE 2

| | Average AgI content (%) | Average grain size (μm) | Variation coefficient according to grain size (%) | Diameter-to-thickness ratio | Silver amount ratio (AgI content) |
|---|---|---|---|---|---|
| Emulsion A | 4.0 | 0.45 | 27 | 1 | Core/shell = 1/3 (13/1), double-structure grains |
| Emulsion B | 8.9 | 0.70 | 14 | 1 | Core/shell = 3/7 (25/2), double-structure grains |
| Emulsion C | 10 | 0.75 | 30 | 2 | Core/shell = 1/2 (24/3), double-structure grains |
| Emulsion D | 16 | 1.05 | 35 | 2 | Core/shell = 4/6 (40/0), double-structure grains |
| Emulsion E | 10 | 1.05 | 35 | 3 | Core/shell = 1/2 (24/3), double-structure grains |
| Emulsion F | 4.0 | 0.25 | 28 | 1 | Core/shell = 1/3 (13/1), double-structure grains |
| Emulsion G | 14.0 | 0.75 | 25 | 2 | Core/shell = 1/2 (42/0), double-structure grains |
| Emulsion H | 14.5 | 1.30 | 25 | 3 | Core/shell = 37/63 (34/3), double-structure grains |
| Emulsion I | 1 | 0.07 | 15 | 1 | Uniform grains |

EX-1

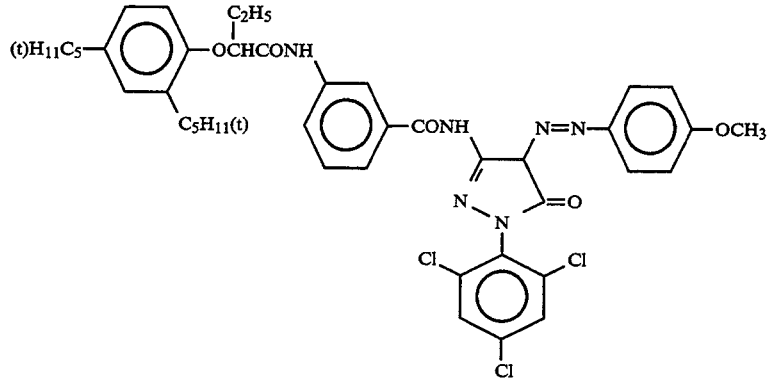

TABLE 2-continued
EX-2
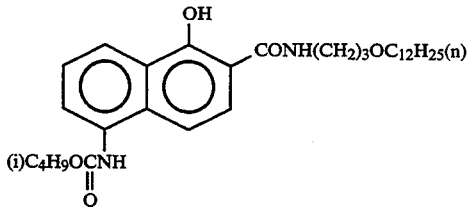
EX-3
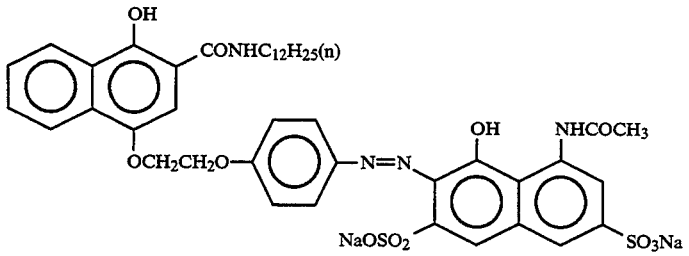
EX-4
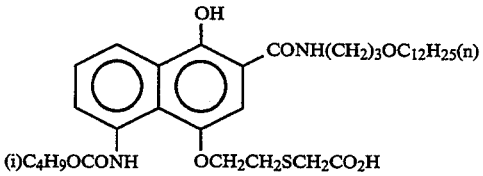
EX-5
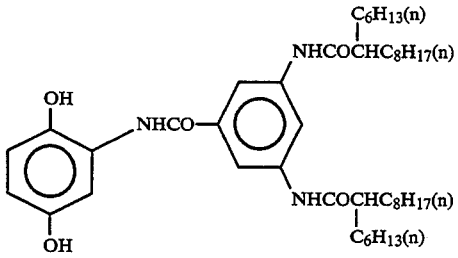
EX-6
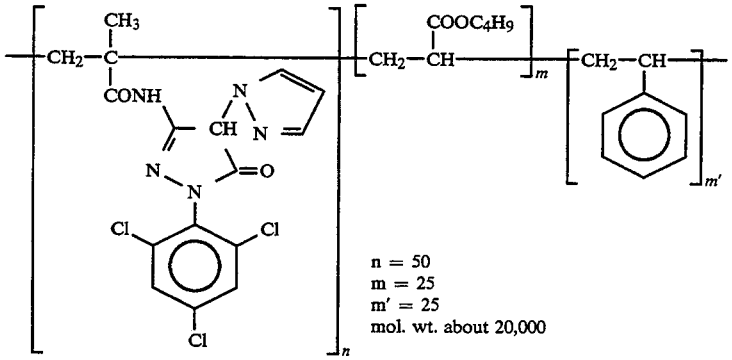
EX-7
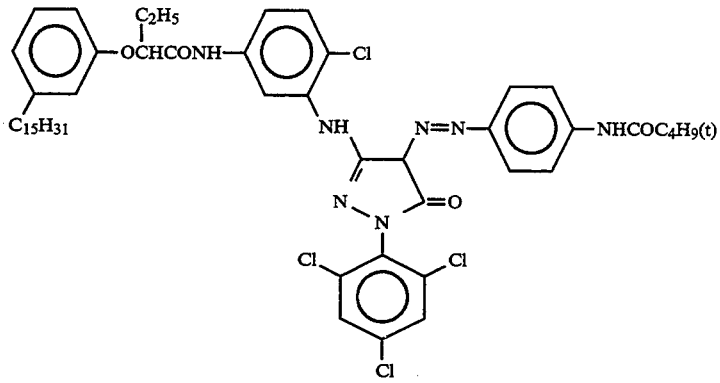

TABLE 2-continued
EX-8
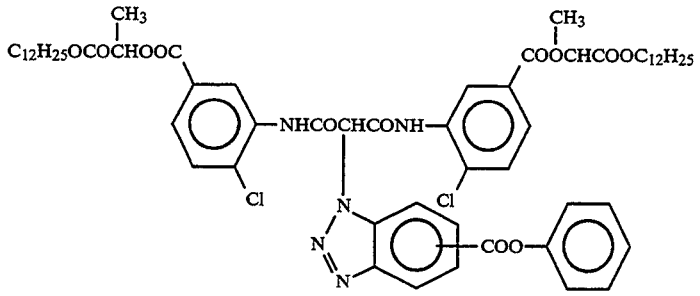
EX-9
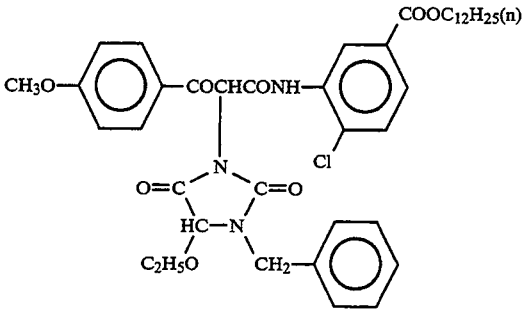
EX-10
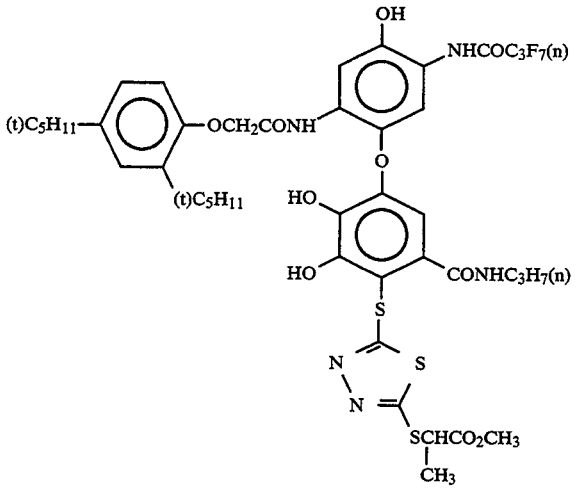
EX-11
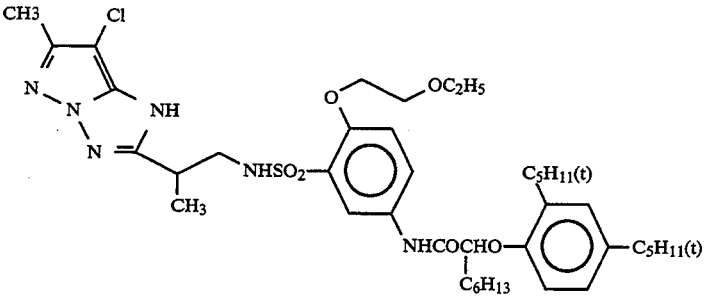
EX-12
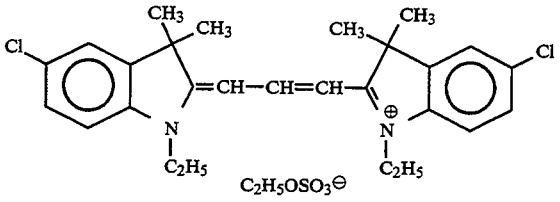

TABLE 2-continued
EX-13
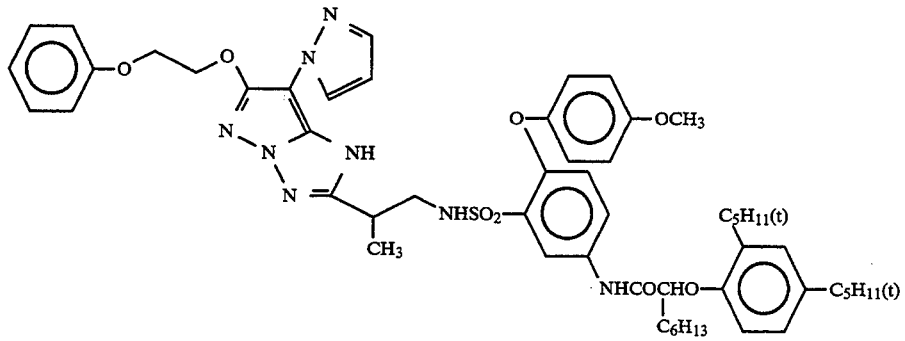
EX-14
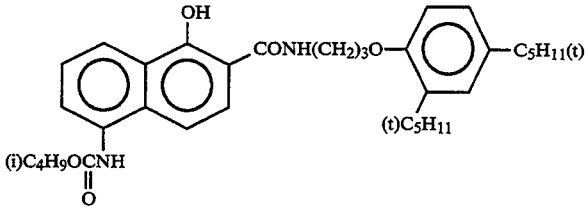
EX-15
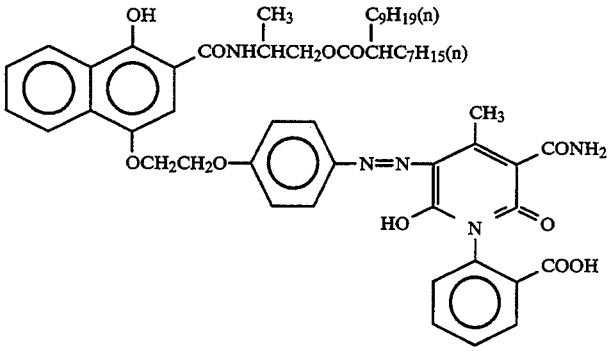
U-1
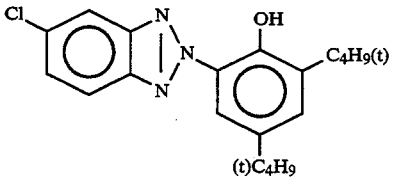
U-2
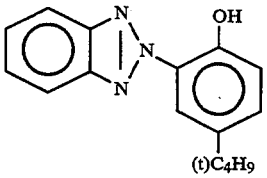
U-3
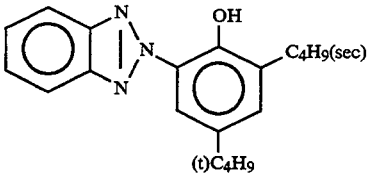

TABLE 2-continued
U-4
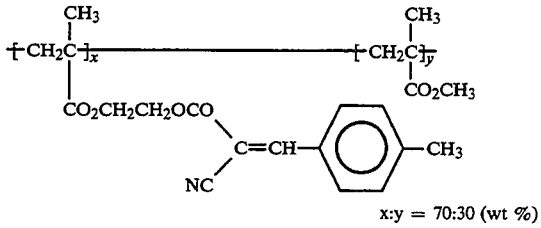
x:y = 70:30 (wt %)
U-5
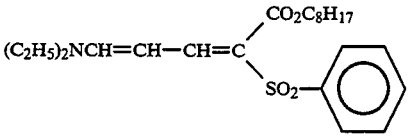
HBS-1 Tricresyl phosphate
HBS-2 Di-n-bntylphthalate
HBS-3
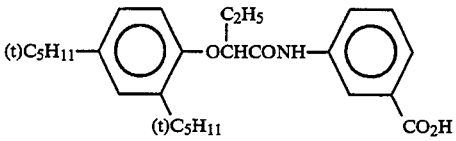
Sensitizing Dye I
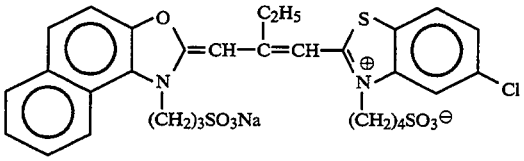
Sensitizing Dye II
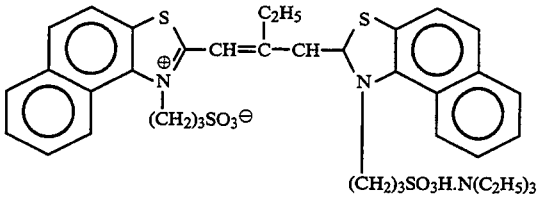
Sensitizing Dye III
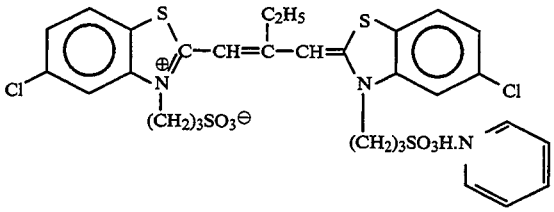
Sensitizing Dye IV
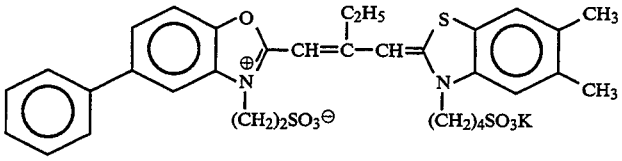
Sensitizing Dye V
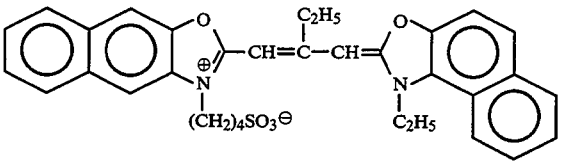

TABLE 2-continued
Sensitizing Dye VI
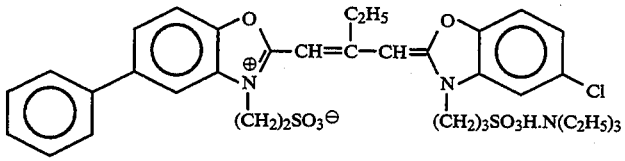
Sensitizing Dye VII
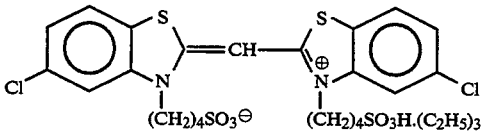
S-1
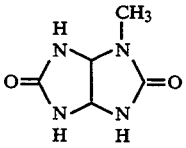
H-1
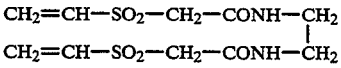
B-1
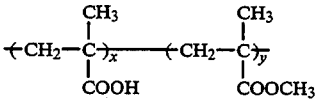
x/y = 10/90
B-2
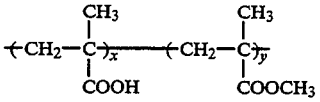
x/y = 40/60
B-3
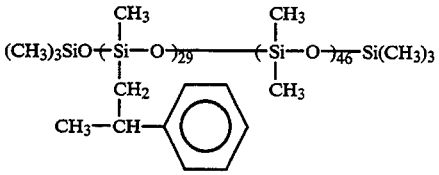
B-4
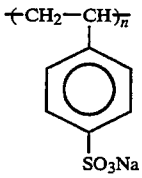
B-5
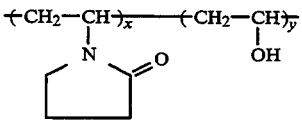
x/y = 70/30
W-1
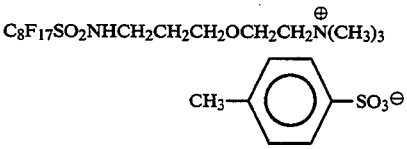
W-2
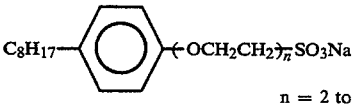
n = 2 to 4

TABLE 2-continued
W-3
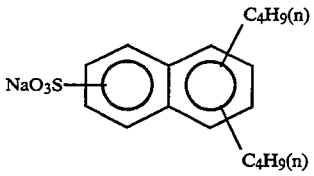
F-1
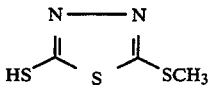
F-2
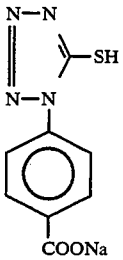
F-3
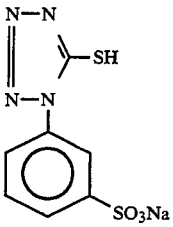
F-4
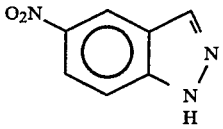
F-5
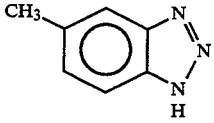
F-6
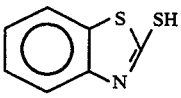
F-7
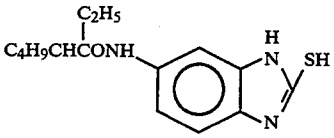
F-8
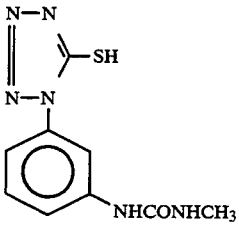

TABLE 2-continued

| | |
|---|---|
| F-9 | 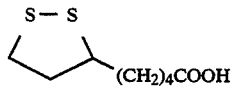 |
| F-10 | 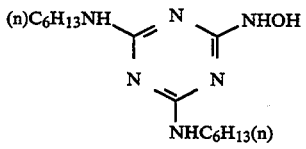 |
| F-11 | 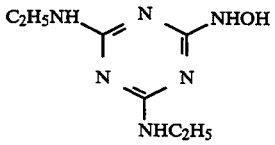 |
| F-12 | 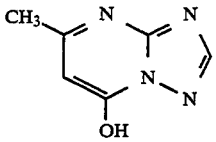 |
| F-13 | 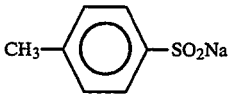 |

(Samples 102 to 108)

Sample 102 to 108 were prepared in the same way as Sample 101, except that the layer 5 was formed of an emulsion different from Emulsion Em-A (subjected to gold-sulfur sensitization), as is shown in Table 3 (later presented).

Samples 101 to 108, thus prepared, were exposed. Next, Samples 101 to 108 were developed by means of an automatic developing machine, and were processed by the method specified below, until the amount of the solution replenished amounted to three times the volume of the motor-solution tank.

| Processing method | | | | |
|---|---|---|---|---|
| Process | Time | Temp. | Replenish Amount* | Tank volume |
| Color development | 3 min. 15 sec. | 38° C. | 15 ml | 20 l |
| Bleaching | 6 min. 30 sec. | 38° C. | 10 ml | 40 l |
| Washing | 2 min. 10 sec. | 35° C. | 10 ml | 20 l |
| Fixing | 4 min. 20 sec. | 38° C. | 20 ml | 30 l |
| Washing (1) | 1 min. 05 sec. | 35° C. | ** | 10 l |
| Washing (2) | 1 min. 00 sec. | 35° C. | 20 ml | 10 l |
| Stabilization | 1 min. 05 sec. | 38° C. | 10 ml | 10 l |
| Drying | 4 min. 20 sec. | 55° C. | | |

*Replenishing amount per meter of a 35-mm wide sample
**Counter flow from the step (2) to the step (1)

The compositions of the solutions used in the color developing process are as follows:

| | Mother Solution (g) | Replenishment Solution (g) |
|---|---|---|
| (Color Developing Solution) | | |
| Diethylenetriaminepentaacetate | 1.0 | 1.1 |
| 1-hydroxyethylidene-1,1-diphosphonic acid | 3.0 | 3.2 |
| Sodium sulfite | 4.0 | 4.9 |

-continued

| | Mother Solution (g) | Replenishment Solution (g) |
|---|---|---|
| Potassium carbonate | 30.0 | 30.0 |
| Potassium bromide | 1.4 | |
| Potassium iodide | 1.5 mg | — |
| Hydroxylamine sulfate | 2.4 | 3.6 |
| 4-(N-ethyl-N-β-hydroxylethyl-amino)-2-methylaniline sulfate | 4.5 | 7.2 |
| Water to make | 1.0 l | 1.0 l |
| pH | 10.05 | 10.10 |
| (Bleaching Solution) | | |
| Sodium ferric ethylenediamine tetraacetate trihydrate | 100.0 | 140.0 |
| Disodium ethylenediamine tetra-acetate | 10.0 | 11.0 |
| Ammonium bromide | 140.0 | 180.0 |
| Ammonium nitrate | 30.0 | 40.0 |
| Ammonia water (27%) | 6.5 ml | 2.5 ml |
| Water to make | 1.0 l | 1.0 l |
| pH | 6.0 | 5.5 |
| (Fixing Solution) | | |
| Disodium ethylenediamine tetra-acetate | 0.5 | 1.0 |
| Sodium sulfite | 7.0 | 12.0 |
| Sodium bissulfite | 5.0 | 9.5 |
| Ammonium thiosulfate aqueous solution (70%) | 170.0 ml | 240.0 ml |
| Water to make | 1.0 l | 1.0 l |
| pH | 6.7 | 6.6 |
| (Washing Solution) | | |
| Prepared by passing tap water through a mixed column filled with H-type strong-acid cation exchange resin (Amberlite IR-120B) and OH-type an exchange resin (Amberlite IR-400), both manufactured by Rome and Harse, Inc., adjusting the calcium and magnesium ion concentration to 3 mg/l or less, and adding sodium dichloroisocyanurate and sodium sulfate in amounts of 20 mg/l and 1.5 g/l, respectively. This solution had a pH value ranging from 6.5 to 7.5. | | |
| (Stabilizing Solution) | | |
| Formalin (37%) | 2.0 ml | 3.0 ml |
| Polyoxyethylene-p-monononyl phenyl ether (Average polymerization degree: 10) | 0.3 | 0.45 |

-continued

| | Mother Solution (g) | Replenishment Solution (g) |
|---|---|---|
| Disodium ethylenediamine tetra-acetate | 0.05 | 0.08 |
| Water to make | 1.0 l | 1.0 l |
| pH | 5.0 to 8.0 | 5.0 to 8.0 |

The sensitivities of Samples 101 to 108 were evaluated in the reciprocal of the exposure amount required to give a cyan image an optical density of fog +0.1. Further, the graininesses of Samples 101 to 108 were evaluated by the same method as those of Samples 1 to 8 (Example 1). The results were as is shown in the following Table 3.

TABLE 3

| Sample | | Em | Grain shape | Dislocation Lines | Chemical Sensitization | Relative Sensitivity | Relative graininess |
|---|---|---|---|---|---|---|---|
| 101 | Comparative Example | A | Tabular | to 0 | Gold—Sulfur | 100 | 100 |
| 102 | Comparative Example | A | Tabular | to 0 | Gold—Sulfur—Tellurium | 110 | 103 |
| 103 | Comparative Example | B | Tabular | 10 or more | Gold—Sulfur | 117 | 98 |
| 104 | Present Invention | B | Tabular | 10 or more | Gold—Sulfur—Tellurium | 136 | 94 |
| 105 | Comparative Example | C | Octahedral | to 0 | Gold—Sulfur | 100 | 100 |
| 106 | Comparative Example | C | Octahedral | to 0 | Gold—Sulfur—Tellurium | 113 | 105 |
| 107 | Comparative Example | D | Octahedral | 10 or more | Gold—Sulfur | 111 | 99 |
| 108 | Present Invention | D | Octahedral | 10 or more | Gold—Sulfur—Tellurium | 136 | 94 |

As is evident from Table 3, the emulsions used in Samples 104 and 108, both according to the present invention, had high sensitivity and good graininess, demonstrating the advantages of the present invention.

As has been described above, the present invention can provide an emulsion which excels in sensitivity/-graininess ratio. Also can the invention provide a low-fog emulsion.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A silver halide emulsion which contains grains made of silver chloroiodobromide, silver iodobromide, br silver chlorobromide, each of said grains having at least one dislocation line and chemically sensitized with at least one tellurium sensitizer represented by the following formula (IIA):

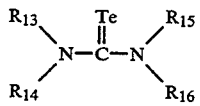

(IIA)

where $R_{13}$ and $R_{15}$ each represent an aliphatic group or an aromatic group, said $R_{13}$ and $R_{15}$ combining with each other to form a ring together with N—C—N; and each of $R_{14}$ and $R_{16}$ represents an alkyl group or an aromatic group.

2. The emulsion according to claim 1, wherein each of said grains has at least 10 dislocation lines.

3. The emulsion according to claim 1, wherein said grains are tabular grains having an aspect ratio of at least 3.

4. The emulsion according to claim 1, wherein $R_{13}$ and $R_{15}$ each represents an alkylene group, an alkenylene group, an aralkylene group, or an arylene group.

5. A silver halide photographic light-sensitive material, comprising at least one emulsion layer containing an emulsion of claim 1.

6. A silver halide emulsion which contains grains made of silver chloroiodobromide, silver iodobromide, or silver chlorobromide, each of said grains having at least one dislocation line and chemically sensitized with at least one tellurium sensitizer represented by the following formula (IIB):

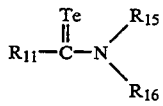

(IIB)

where $R_{11}$ and $R_{15}$ each represent an aliphatic group or an aromatic group or combine with each other to form a ring together with C—N; and $R_{16}$ represents an alkyl group or an aromatic group.

7. The emulsion according to claim 6 wherein each of said grains has at least 10 dislocation lines.

8. The emulsion according to claim 6, wherein said grains are tabular grains having an aspect ratio of at least 3.

9. The emulsion according to claim 6, wherein $R_{11}$ and $R_{15}$ each represents an alkylene group.

10. A silver halide photographic light-sensitive material, comprising at least one emulsion layer containing an emulsion of claim 6.

11. A silver halide emulsion which contains grains made of silver chloroiodobromide, silver iodobromide, or silver chlorobromide, each of said grains having at least one dislocation line and chemically sensitized with at least one tellurium sensitizer represented by the following formula (I):

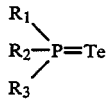

(I)

where each of $R_1$, $R_2$ and $R_3$ represents an aliphatic group, an aromatic group, a heterocyclic group, $OR_4$, $NR_5(R_6)$, $SR_7$, $OSiR_8(R_9)(R_{10})$, a halogen atom or a hydrogen atom; each of $R_4$ and $R_7$ represents an aliphatic group, an aromatic group, a heterocyclic group, a hydrogen atom or a cation; each of $R_5$ and $R_6$ represents an aliphatic group, an aromatic group, a heterocyclic group, or a hydrogen atom; and each of $R_8$, $R_9$ and $R_{10}$ represents an aliphatic group; wherein $R_1$ and $R_2$, $R_2$ and $R_3$, or $R_1$ and $R_3$ may combine together to form a ring with P, and $R_5$ and $R_6$ may combine together to form a ring.

12. The emulsion according to claim 11, wherein each of said grains has at least 10 dislocation lines.

13. The emulsion according to claim 11, wherein said grains are tabular grains having an aspect ratio of at lease 3.

14. A silver halide photographic light-sensitive material, comprising at least one emulsion layer containing an emulsion of claim 11.

* * * * *